US006315611B1

(12) United States Patent
Sawada et al.

(10) Patent No.: US 6,315,611 B1
(45) Date of Patent: Nov. 13, 2001

(54) METAL TERMINAL FOR WEDGE-BASE BULB

(75) Inventors: Hisashi Sawada, Mie; Kihachiro Uchida; Kazuto Nitta, both of Shizuoka, all of (JP)

(73) Assignees: Sumitomo Wiring Systems, Ltd.; Koita Manufacturing Co., Ltd.

( * ) Notice: Subject to any disclaimer, the term of this patent is extended or adjusted under 35 U.S.C. 154(b) by 0 days.

(21) Appl. No.: 09/419,976

(22) Filed: Oct. 18, 1999

(30) Foreign Application Priority Data

Oct. 20, 1998 (JP) ..... 10-297971

(51) Int. Cl.[7] ..... H01R 17/00
(52) U.S. Cl. ..... 439/619; 439/699.2; 439/856
(58) Field of Search ..... 439/619, 611, 439/617, 699.2, 699.1, 736, 856

(56) References Cited

U.S. PATENT DOCUMENTS 5,507,670 * 4/1996 Ogawa ..... 439/619
5,743,617 * 4/1998 Sato et al. ..... 439/619
5,876,249 * 3/1999 Kim ..... 439/619

FOREIGN PATENT DOCUMENTS 2-82887 6/1990 (JP) .
7-254466 10/1995 (JP) .

* cited by examiner

*Primary Examiner*—Hien Vu
(74) *Attorney, Agent, or Firm*—Oliff & Berridge, PLC.

(57) ABSTRACT

A retaining projection 37 for engagement in a retaining groove 14, formed in a base portion 12 of a bulb 10, is formed on one of a pair of holder pieces 34 of a metal terminal 30, and a connecting projection 36 is formed on the other holder piece 34, and this connecting projection 36 is to be opposed to that portion of a lead wire 13 lying between its proximal end portion and its intermediate portion, and is projected toward the lead wire 13 so as to be held against the lead wire 13. With this construction, even if the base portion 12 is held between the holder pieces 34 and 34, with the distal end portion of the lead wire 13 displaced to be tilted, the connecting projection 36 never fails to be held against the proximal end portion of the lead wire 13, thereby positively achieving an electrical connection therebetween.

2 Claims, 5 Drawing Sheets

METAL TERMINAL FOR WEDGE-BASE BULB

BACKGROUND OF THE INVENTION

This invention relates to a metal terminal for a wedge-base bulb (baseless bulb).

FIGS. 5 to 7 show a common wedge-base bulb (hereinafter referred to as "bulb") and conventional metal terminals for a wedge-base bulb.

The bulb 10 comprises a hollow light-emitting portion 11 of a generally cylindrical shape, and a flat plate-like base portion 12 formed at a lower end of the light-emitting portion 11. Lead wires 13, received in the light-emitting portion 11, are extended outwardly respectively from opposite end portions of a bottom surface 12A of the base portion 12, and these outwardly-extended portions are folded respectively on holding surfaces 12B and 12B of the base portion 12, facing away from each other, to form contacts arranged in a point-symmetrical manner. A retaining groove 14 is formed in an upper portion of each of the holding surfaces 12B, and extends in a horizontal direction.

The conventional metal terminal 1 includes a pair of holder pieces 2 and 2 which can hold the base portion 12 therebetween, and are symmetrical in shape. Each of the holder pieces 2 and 2 has a retaining projection 3 formed at a distal end thereof, and the two retaining projections 3 and 3 are curved or projected toward each other. When the base portion 12 is inserted between the holder pieces 2 and 2, the retaining projections 3 are engaged respectively in the retaining grooves 14 in the base portion 12 to thereby retain the bulb 10 against withdrawal, and at the same time one of the holder pieces 2 is held against the lead wire 13, and hence is electrically connected thereto. The above-mentioned metal terminal 1 is disclosed, for example, in the Unexamined Japanese Utility Model Application Publication No. Hei 2-82887.

Each lead wire 13 is extended outwardly from the bottom surface 12A of the base portion 12, and is folded upwardly to be merely laid on the holding surface 12B. Therefore, in some cases, the distal end portion of the lead wire 13 is displaced to be tilted, as shown in FIG. 7. As a result, in the conventional metal terminal 1, the lead wire 13 is received in a recessed portion of the holder piece 2, which is closer to the proximal end of the holder piece 2 than the retaining projection 3 is, and this results in a problem that the holder piece 2 fails to be held against the lead wire 3, thus causing a contact failure.

SUMMARY OF THE INVENTION

This invention has been made in view of the above problem, and an object of the invention is to provide a metal terminal for a wedge-base bulb which can be electrically connected to a lead wire of the wedge-base bulb in a stable manner.

The above object has been achieved by a wedge-base bulb metal terminal of the invention of aspect 1 comprising a pair of holder pieces received within a bulb socket into which a flat plate-like base portion of the wedge-base bulb is adapted to be inserted, wherein the pair of holder pieces are adapted to hold the base portion therebetween, and the holder piece is adapted to be electrically connected to that portion of a lead wire which is extended outwardly from a bottom surface of the base portion, and is laid on a holding surface of the base portion, and that portion of the outwardly-extended portion of the lead wire, disposed adjacent to the bottom surface, serves as a proximal end portion thereof; CHARACTERIZED in that a retaining projection for engagement in a retaining groove, formed in the base portion, is formed on one of the pair of holder pieces, and a connecting projection for being held at least against the proximal end portion of the lead wire is formed on the other holder piece.

In the wedge-base bulb metal terminal of the invention of aspect 2 according to aspect 1, the connecting projection is adapted to be held against that portion of the lead wire, lying between the proximal end portion thereof and an intermediate portion thereof, therealong in a direction of a height.

(Th e Invention of Aspect 1)

The base portion of the wedge-base bulb, inserted into the bulb socket, is held between the pair of holder pieces, and the connecting projection, formed on the one holder piece, is held against the lead wire, laid on the base portion, and hence is electrically connected thereto,whereas the retaining projection, formed on the other holder piece, is engaged in the retaining groove, formed in the base portion, thereby retaining the bulb against withdrawal. Even if the distal end portion of the lead wire is displaced to be tilted, the connecting projection is held at least against the proximal end portion of the lead wire, thereby positively achieving the electrical connection.

(The Invention of Aspect 2)

In a normal condition in which the lead wire extends straight, the connecting projection is held against that portion of the lead wire, lying between the proximal end portion thereof and the intermediate portion thereof, therealong in the direction of the height, and therefore the area of contact therebetween is increased, so that the electrically-connected condition is good. Even if the distal end portion of the lead wire is displaced to be tilted, the connecting projection is held at least against the proximal end portion of the lead wire, thereby positively achieving the electrical connection.

DETAILED DESCRIPTION OF THE PREFERRED EMBODIMENTS (First Embodiment)

Figure 1:
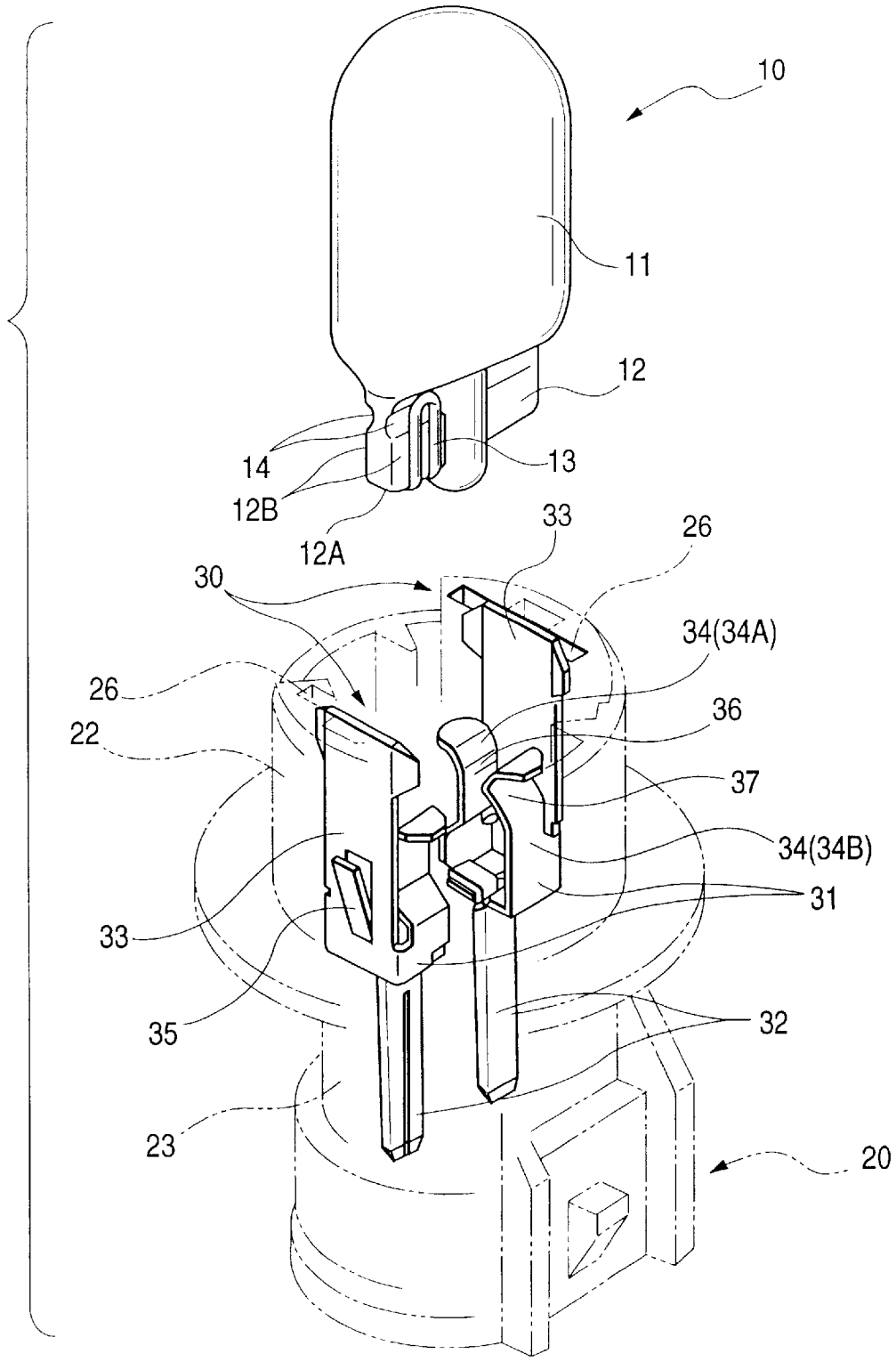
FIG. 1 is a perspective view showing a first embodiment of metal terminals of the present invention as well as a bulb.
Figure 2:
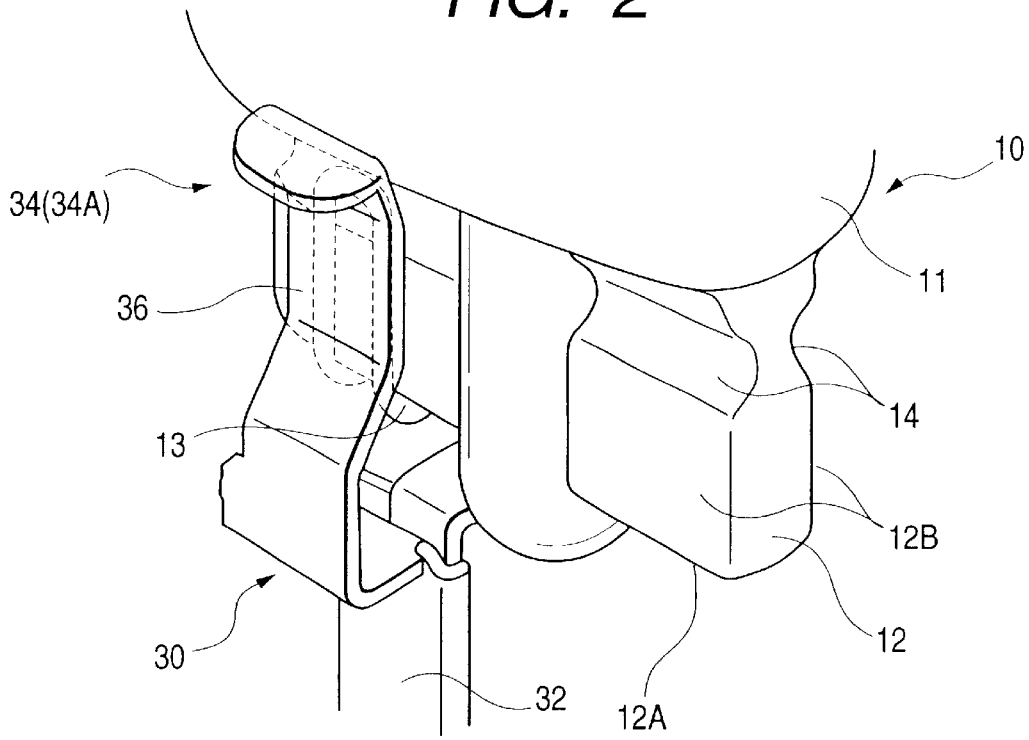
FIG. 2 is a fragmentary, perspective view showing the metal terminal and a base portion of the bulb on an enlarged scale.
Figure 3:
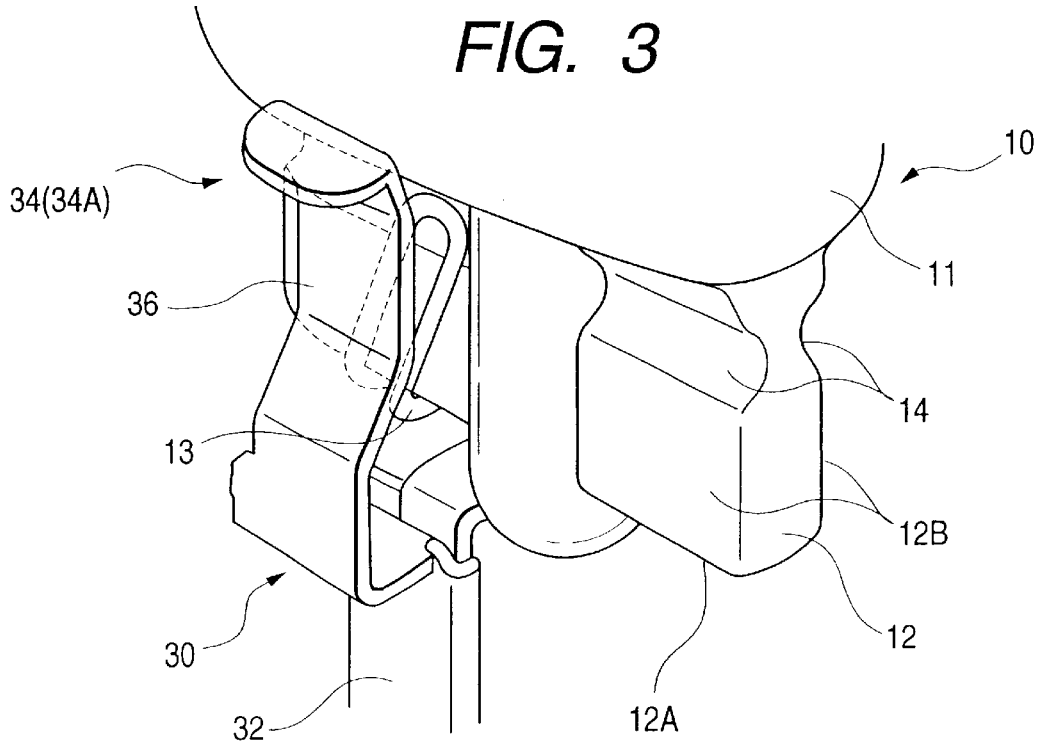
FIG. 3 is an enlarged, fragmentary perspective view showing a condition in which a distal end portion of a lead wire is displaced out of position.

A first embodiment of the present invention will now be described with reference to FIGS. 1 to 3. A wedge-base bulb 10 is the same as that described in "the Prior Art section" of this specification, and therefore description thereof will be omitted. As shown in FIG. 1, a bulb socket 20 includes a bulb receiving portion 22, which is open upwardly for receiving a base portion 12 of the bulb 10, and a hood portion 23 which extends from the bulb receiving portion 22, and is open downwardly for receiving a mating connector (not shown). The bulb receiving portion 22 and the hood portion 23 are separated from each other by a partition wall (not shown) formed within the bulb socket 20.

A pair of metal terminals 30 and 30, embodying the present invention, are received within the bulb socket 20 in opposed relation to each other. The metal terminal 30 includes a connection portion 31 for connection to the base portion 12 of the bulb 10, and a flat plate-like tab 32 extending from a lower side of the connection portion 31. The connection portion 31 of each metal terminal 30 is received within the bulb receiving portion 22, with the tab 32 extending through the partition wall into the interior of the hood portion 23 (that is, the tab 32 projects from the inner end surface of the hood portion 23).

The connection portion 31 includes a base plate 33 (comprising a flat plate), and opposite side portions of a lower end portion of the base plate 33 are bent at right angles to be opposed to each other, thereby providing a pair of upwardly-extending holder pieces 34 and 34, respectively. The base plate 33 of each connection portion 31 is received in a corresponding receiving groove 26, formed in the bulb receiving portion 22, and is retained in position by a lance 35 formed by stamping on the base plate 33.

The two holder pieces 34 (that is, the holder piece 34 (hereinafter referred to as "connecting holder piece 34A") for facing a lead wire 13, laid on the base portion 12 of the bulb 10, and the holder piece 34 (hereinafter referred to as "retaining holder piece 34B") for facing that side of the base portion 12 facing away from the lead wire 13) are different in shape from each other. The connecting holder piece 34A has a connecting projection 36 curved or projected toward the retaining holder piece 34B over a wide range between the proximal end portion thereof to the distal end portion thereof. On the other hand, the distal end portion of the retaining holder piece 34B is curved or projected toward the connecting holder piece 34A to form a retaining projection 37. The distal end portions of the two holder pieces 34 are generally rounded away from each other so that the base portion 12 can be easily guided into the gap between the two holder pieces 34.

Next, the operation and effects of this embodiment of the above construction will be described.

When the base portion 12 of the bulb 10 is inserted into the bulb socket 20, a bottom surface 12A of the base portion 12 is brought into contact with the distal ends of the holder pieces 34 and 34 of each metal terminal. When the base portion 12 is further pushed into the bulb socket 20, it is inserted between the two holder pieces 34 and 34 while moving them away from each other. Then, when the base portion 12 is further inserted into a predetermined position, the connecting projection 36 of the connecting holder piece 34A is held against the lead wire 13, laid on the base portion 12, therealong in a vertical direction, and hence is electrically connected to this lead wire 13 (see FIG. 2), and at the same time the retaining projection 37 of the retaining holder piece 34B is engaged in a retaining groove 14, formed in the base portion 12, thereby retaining the bulb against withdrawal.

Each lead wire 13 is extended outwardly from the bottom surface 12A of the base portion 12, and is folded upwardly to be merely laid on a holding surface 12B of the base portion 12. Therefore, in some cases, the distal end portion of the lead wire 13 is displaced to be tilted as shown in FIG. 3. However, the connecting projection 36 of the connecting holder piece 34A is to be opposed to that portion of the lead wire 13 lying between its proximal end portion and its intermediate portion (i.e., that portion of the lead wire 13 intermediate the proximal and distal ends), and this connecting projection 36 is projected toward the lead wire 13, and therefore is held at least against the proximal end portion of the lead wire 13.

Thus, in the metal terminal 30 of this embodiment, when the lead wire 13 is in its normal condition, that is, extends straight, the connecting projection 36 is held against that portion of the lead wire 13, lying between the proximal end portion thereof and the intermediate portion thereof, therealong in the direction of the height, and therefore the area of contact therebetween is increased, so that the electrically-connected condition is good. Even if the distal end portion of the lead wire 13 is displaced to be tilted, the connecting projection 36 is held at least against the proximal end portion of the lead wire 13, thereby positively achieving the electrical connection.

(Second Embodiment)

Figure 4:
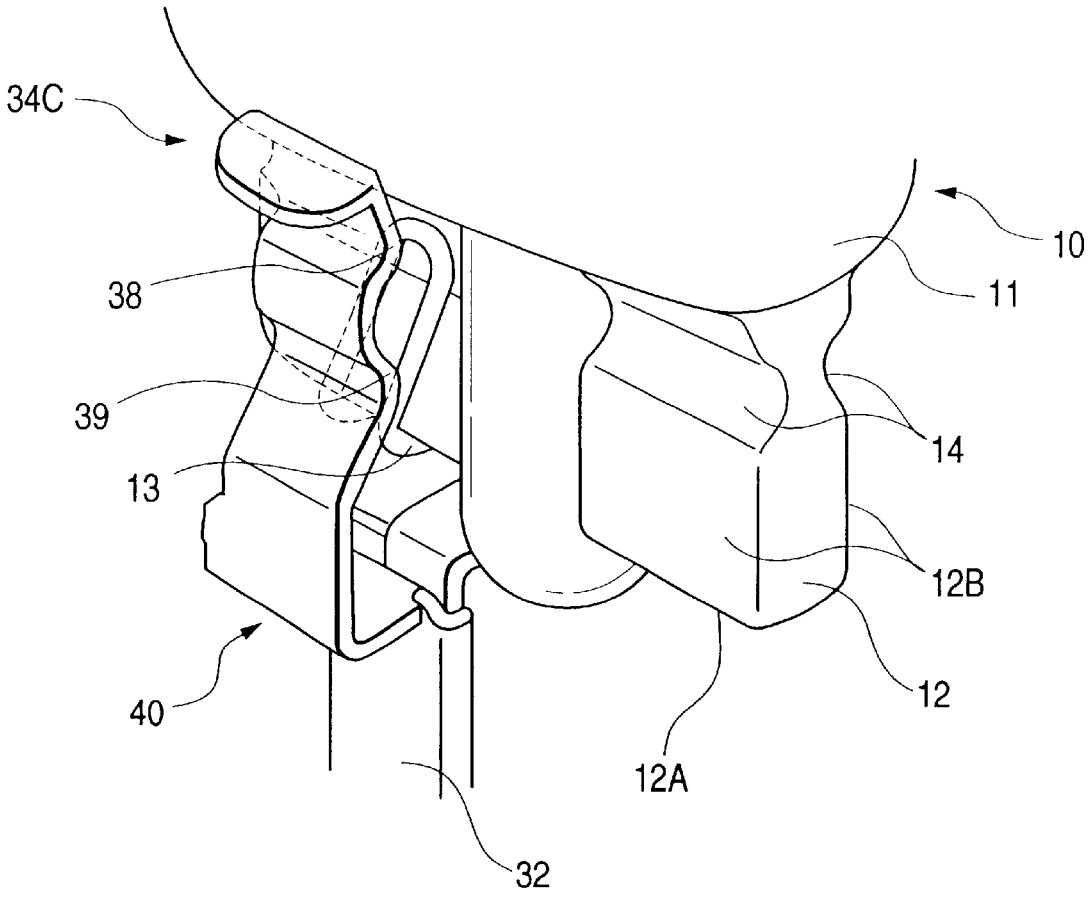
FIG. 4 is a fragmentary, perspective view showing a metal terminal of a second embodiment and the base portion of the bulb on an enlarged scale.
Figure 5:
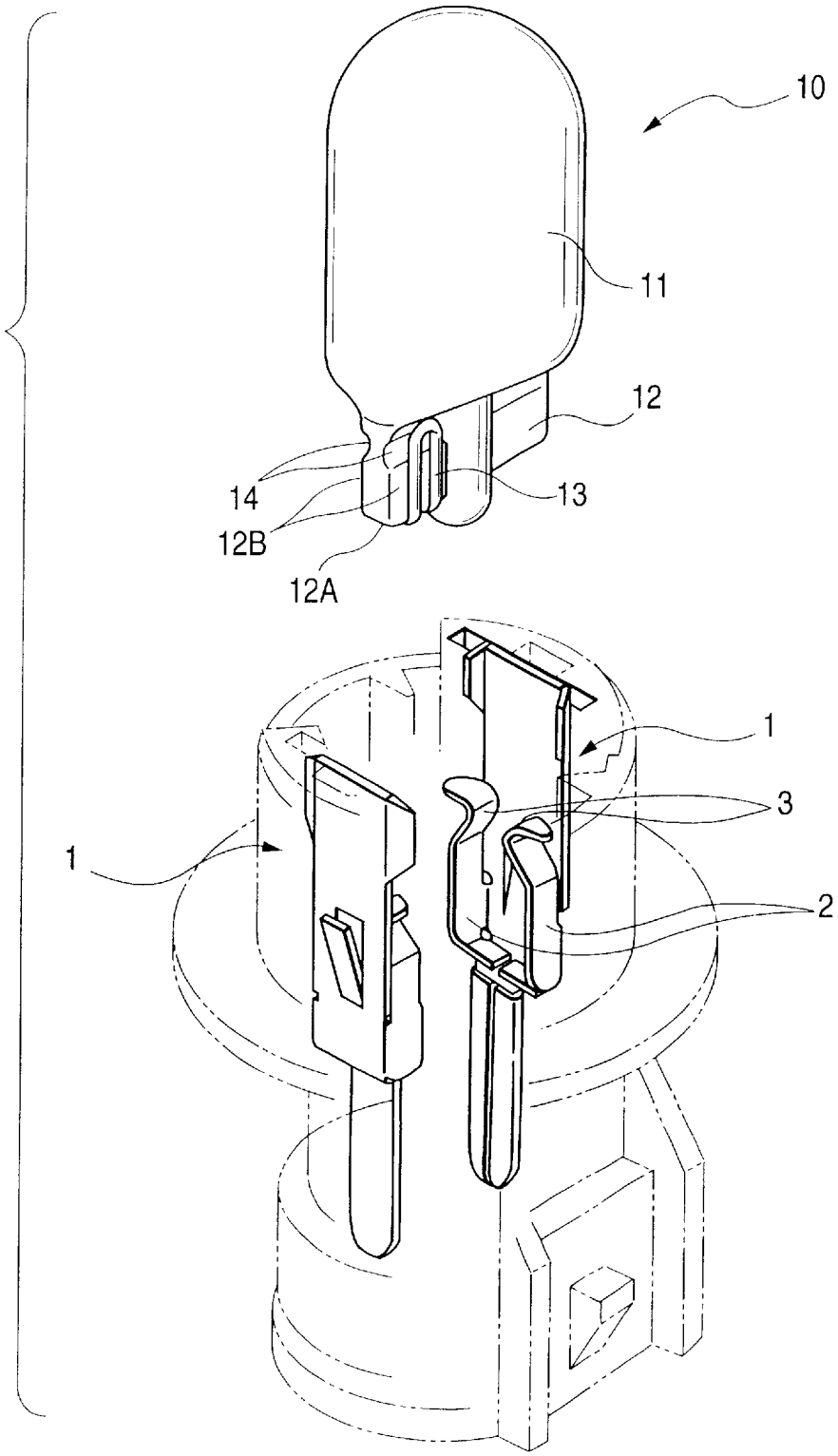
FIG. 5 is a perspective view showing conventional metal terminals and a bulb.
Figure 6:
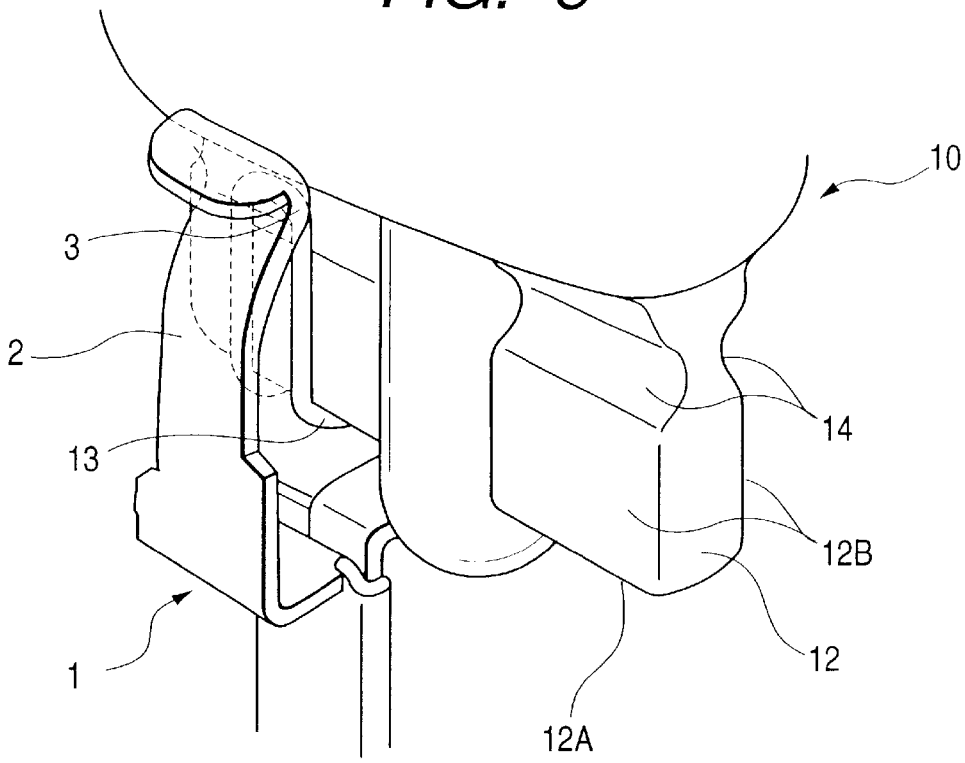
FIG. 6 is a fragmentary, perspective view showing the conventional metal terminal and a base portion of the bulb on an enlarged scale.
Figure 7:
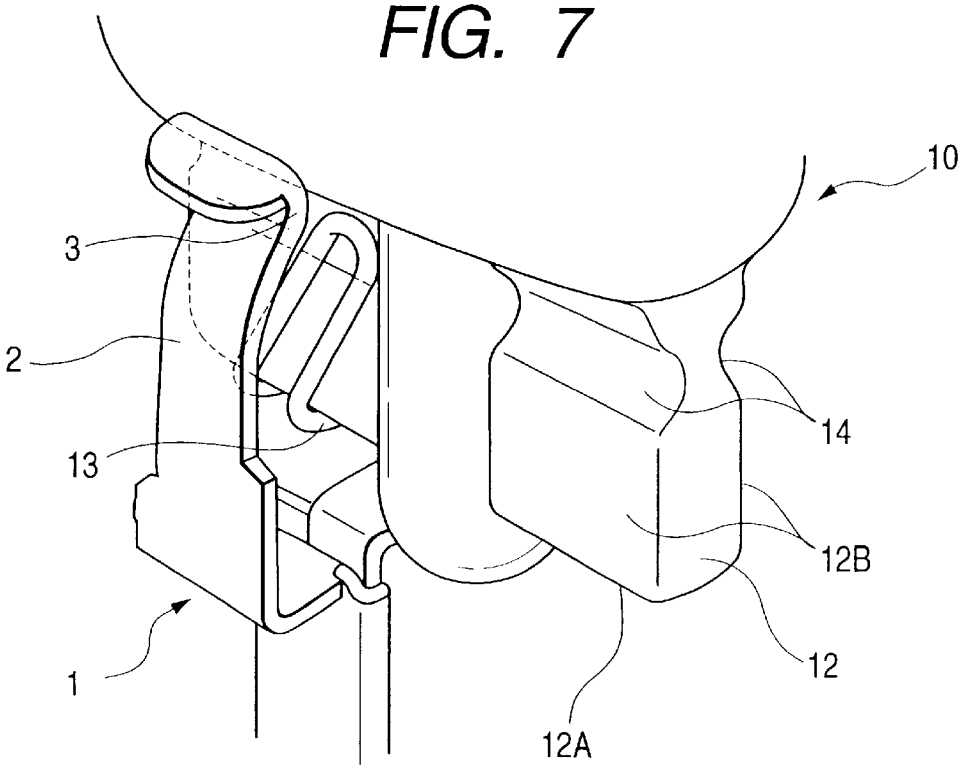
FIG. 7 is an enlarged, fragmentary perspective view showing a condition in which a distal end portion of a lead wire is displaced out of position, so that the lead wire is not electrically connected to the conventional metal terminal.

A metal terminal 40 of this embodiment is shown in FIG. 4, and differs from the metal terminal 30 of the first embodiment only in the configuration of a connecting holder piece 34C. Only the difference from the metal terminal 30 of the first embodiment will now be described. In the metal terminal 40 of this embodiment, a first connecting projection 38 is formed at a distal end portion of the connecting holder piece 34C, and is curved or projected toward the lead wire 13, and a second connecting projection 39 is formed at a proximal end portion of the holder piece 34C, and is curved or projected toward the lead wire 13.

When the base portion 12 of the bulb 10 is held between the two holder pieces 34 and 34, the first and second connecting projections 38 and 39 of the connecting holder piece 34C are held respectively against the upper end portion and proximal end portion of the lead wire 13, and hence are electrically connected thereto, and at the same time a retaining projection 37 (see FIG. 1) of the retaining holder piece 34B is engaged in the retaining groove 14 formed in the base portion 12, thereby retaining the bulb against withdrawal. Even if the distal end portion of the lead wire 13 is displaced to be tilted as shown in FIG. 4, the second connecting projection 39 of the connecting holder piece 34C, projected toward the proximal end portion of the lead wire 13 in opposed relation thereto, is held against the proximal end portion of the lead wire 13, thereby positively achieving the electrical connection.

The present invention is not limited by the foregoing description and the drawings, and various modifications can be made without departing from the scope of the invention.

What is claimed is:

1. A bulb socket for a wedge-base bulb comprising:

a metal terminal;

said terminal comprising a pair of holder pieces positioned within the bulb socket that receive and hold a flat plate-like base portion of the wedge-base bulb therebetween;

said pair of holder pieces electrically connected to a portion of a lead wire that extends outwardly from a bottom surface of said base portion and is positioned on a holding surface of said base portion;

a retaining projection is formed on one of said pair of holder pieces, said retaining projection engaging a retaining groove formed in said base portion of the wedge-base bulb; and connecting projections that project over a wide range are formed on the other holder piece thereby keeping contact of surface areas of said connecting projections that make an electrical connection with said lead wire so that said connecting projections are held against a proximal end portion and a distal and portion of said lead wire thereby to achieve positively the electrical connection between the lead wire and the connecting projections, the proximal end portion being a portion of the lead wire disposed adjacent to the bottom surface of the base portion, and the distal end portion being a portion of the lead wire disposed adjacent to the retaining groove.

2. The bulb socket for a wedge-base bulb according to claim 1, wherein said connecting projections are formed to be held against a portion of said lead wire that lies between the proximal end portion of said lead wire and an intermediate portion of said lead wire, therealong in a direction of a height of said lead wire.

* * * * *